United States Patent [19]

Ezoe et al.

[11] 4,221,193

[45] Sep. 9, 1980

[54] FUEL INJECTION SYSTEM FOR AN AUTOMOTIVE INTERNAL COMBUSTION ENGINE EQUIPPED WITH A FUEL CUT OFF CONTROL SIGNAL GENERATOR

[75] Inventors: Mitsuhiko Ezoe, Yokosuka; Akio Hosaka, Yokohama, both of Japan

[73] Assignee: Nissan Motor Company Limited, Yokohama City, Japan

[21] Appl. No.: 949,986

[22] Filed: Oct. 10, 1978

[30] Foreign Application Priority Data

Oct. 11, 1977 [JP] Japan ..... 52/120923

[51] Int. Cl.[2] ..... F02B 3/04

[52] U.S. Cl. ..... 123/483; 123/489; 123/493

[58] Field of Search ..... 123/32 EA, 32 EE, 32 EL

[56] References Cited

U.S. PATENT DOCUMENTS

| | | | |
|---|---|---|---|
| 3,789,816 | 2/1974 | Taplin et al. | 123/32 EA |
| 3,916,865 | 11/1975 | Kiencke et al. | 123/32 EA |
| 4,019,470 | 4/1977 | Asano | 123/32 EE |
| 4,089,313 | 5/1978 | Asano et al. | 123/32 EL |
| 4,092,955 | 6/1978 | Reddy | 123/32 EA |
| 4,096,833 | 6/1978 | Sweet | 123/32 EA |
| 4,119,072 | 10/1978 | Asano | 123/32 EE |
| 4,126,107 | 11/1978 | Harada et al. | 123/32 EL |
| 4,138,979 | 2/1979 | Taplin | 123/32 EE |
| 4,148,283 | 4/1979 | Harada et al. | 123/32 EL |

*Primary Examiner*—Charles J. Myhre
*Assistant Examiner*—Raymond A. Nelli
*Attorney, Agent, or Firm*—Schwartz, Jeffery, Schwaab, Mack, Blumenthal & Koch

[57] ABSTRACT

A fuel injection system for an automotive internal combustion engine equipped with a fuel cut off control signal generator comprises a smoothing circuit which smoothes a fuel cut off control signal produced in response to engine parameters. The flow rate of fuel injected via injection valves is controlled in accordance with the pulse width of a valve energization signal where the pulse width thereof is further controlled by the voltage of the fuel cut off control signal so that the fuel flow rate decreases and increases exponentially in the same manner as the voltage of the fuel cut off control signal when the fuel flow is cut off and is reestablished. Two monostable multivibrators and two transistors are provided for selectively transmitting and blocking the fuel cut off control signal so as to prevent misfires of the engine when the fuel flow rate is below a predetermined value.

6 Claims, 7 Drawing Figures

FUEL INJECTION SYSTEM FOR AN AUTOMOTIVE INTERNAL COMBUSTION ENGINE EQUIPPED WITH A FUEL CUT OFF CONTROL SIGNAL GENERATOR

FIELD OF THE INVENTION

This invention generally relates to a fuel injection system for an internal combustion engine of an automotive vehicles. More specifically the present invention relates to such a system in which fuel supply is cut off under predetermined conditions.

BACKGROUND OF THE INVENTION

In a conventional fuel injection system for an internal combustion engine, injection valve or valves are energized for permitting the transmission of fuel therethrough in accordance with pulse width of pulse signals. The pulse width and the frequency of the pulses of the pulse signal are determined basically in accordance with the airflow rate of the intake air and the rotational speed of the engine (r.p.m.) respectively. The pulse width is further modified in accordance with other parameters of the engine such as the opening degree of the throttle valve, engine temperature, intake air temperature, etc. With this arrangement the amount of fuel (fuel flow rate) is regulated in accordance with the pulse width of the pulse signal. In addition to the above-mentioned basic construction of the fuel injection system the system is usually equipped with a fuel cut off control circuit. The fuel cut off control circuit causes the fuel injection system to produce no pulses so that no fuel is fed to the engine, when the rotational speed of the engine is over a predetermined value for instance 1800 rpm while the throttle valve is fully closed. Further the fuel cut off control circuit causes the fuel injection system to produce a pulse signal with which fuel injection is reestablished when the rotational speed of the engine is below a second predetermined value such as 1100 rpm.

The above described method of fuel cut off is adapted to various kinds of fuel injection system which is commonly used and is advantageous for engine brake efficiency, the reduction of harmful components contained in the exhaust gases and the fuel consumption.

This conventional fuel injection system equipped with the above-mentioned fuel cut off control circuit, however, has defects that the vehicle is apt to be subject to shocks when the fuel supply is abruptly stopped or when the amount of fuel is suddenly increased since the engine torque decreases and increases sharply. The shocks due to the radical variation of the fuel flow rate causes the vehicle driver discomfort.

For eliminating the shocks due to the sharp or radical variation of the fuel flow rate, a dashpot may be employed for the accelerator pedal or the throttle valve to gradually recover the original position when released. The improvement provided by the dashpot, however, is not sufficient to reduce the shocks to a desirable extent.

SUMMARY OF THE INVENTION

The present invention has been developed in order to overcome the above-mentioned drawbacks of the conventional fuel injection system equipped with a fuel cut off control signal generator.

According to the present invention, a primary fuel cut off control signal which is of an ON-OFF type is smoothed and thus the voltage of the same gradually changes. Therefore, the pulse width of a pulse signal with which fuel injection valves are energized for permitting the transmission of fuel, gradually changes when the fuel is cut off and when the fuel supply is reestablished. In order to smooth the ON-OFF type fuel cut off control signal a smoothing circuit such as an integrator is employed.

Further according to the present invention, monostable multivibrators are used for permitting and blocking the transmission of the fuel cut off control signal for first and second predetermined periods of time. The voltage of the fuel cut off control signal is arranged to gradually decrease for a first predetermined period of time to a given extent and to suddenly decrease to zero when the primary fuel cut off control signal becomes OFF. The voltage of the fuel cut off control signal is also arranged to abruptly increase to a given extent from zero after the second predetermined period of time and to gradually increase when the primary fuel cut off control signal becomes ON. With this arrangement the fuel flow rate is above a predetermined level when fuel is supplied to the engine so that misfiring due to an abnormally lean mixture is prevented.

It is therefore an object of the present invention to provide an improved fuel injection system equipped with a fuel cut off control signal generator by which shocks due to the radical variation of the engine torque are effectively reduced.

Another object of the present invention is to provide such a system in which the efficiency of the engine brake is maintained within a practical range.

Yet another object of the present invention is to provide such a system in which the fuel consumption is maintained within a reasonable range.

Still further object of the present invention is to provide such a system in which the efficiency of the reduction of harmful components is maintained within a practical range.

BRIEF DESCRIPTION OF THE DRAWINGS

These and other objects and features of the present invention will be readily apparent from the detailed description of the preferred embodiment taken in conjunction with the accompanying drawings in which.

DETAILED DESCRIPTION OF THE PREFERRED EMBODIMENT

Figure 1:
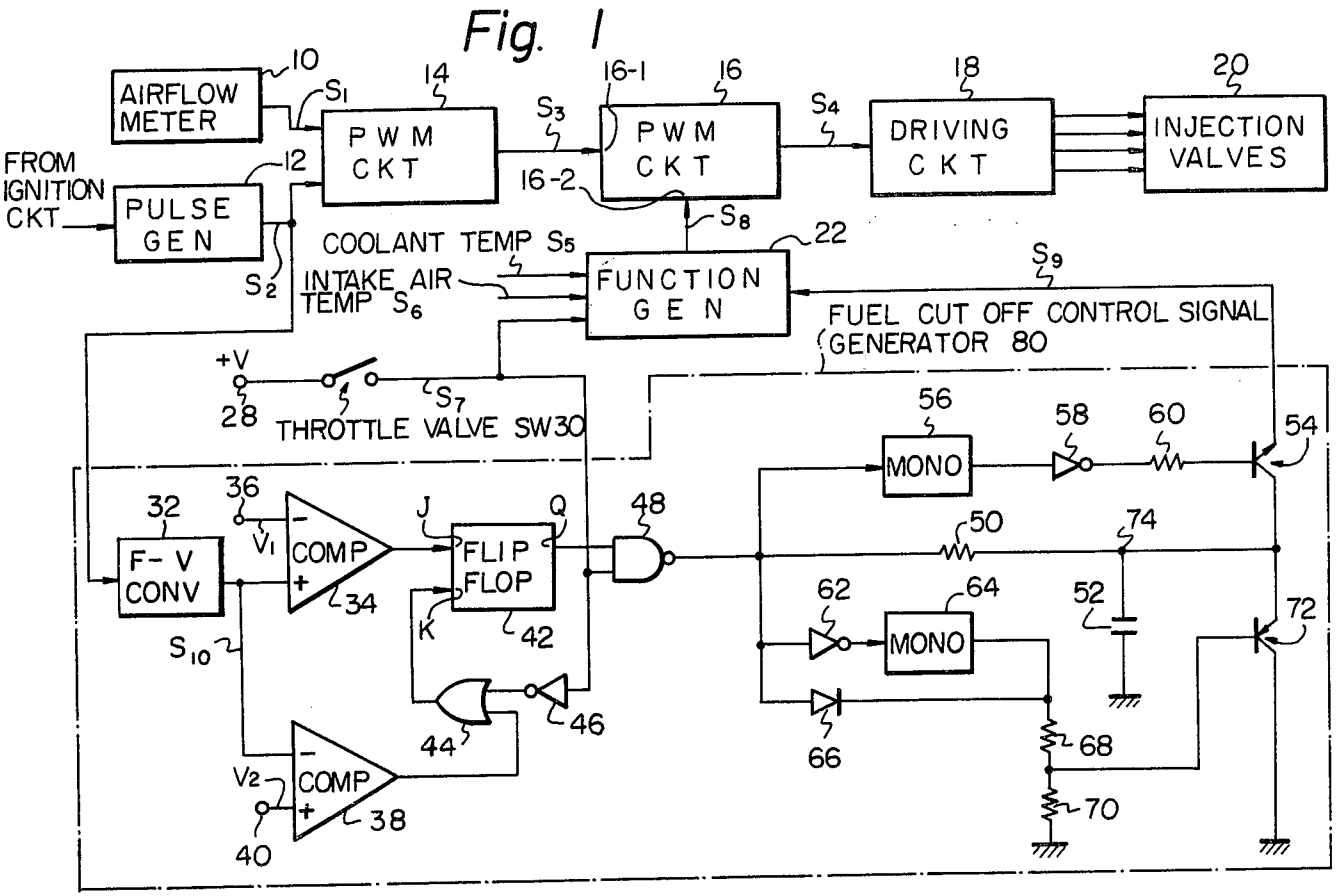
FIG. 1 shows in block diagram form a preferred embodiment of the fuel injection system according to the present invention.

FIG. 1 illustrates in block diagram form, a preferred embodiment of the fuel injection system according to the present invention. The fuel injection system includes an airflow meter 10, a pulse generator 12, first and second pulse width modulation (PWM) circuits 14 and 16, a driving circuit 18, injection valves 20, a function generator 22, a throttle valve switch 30, and a fuel cut off control signal generator 80. The circuit arrangement shown in FIG. 1 is the same conventional fuel injection system except for the fuel cut off control signal generator 80.

The airflow meter 10 may be a potentiometer operatively connected to the throttle valve of the engine (not shown) so that the output of the airflow meter 10 varies in accordance with the airflow rate of the intake air. The output signal indicative of the airflow rate is designated by a reference $S_1$. The pulse generator 12 is responsive to the ignition pulses derived from the ignition circuit such as the distributor (not shown). The pulse generator 12, in fact, includes a divider which divides a number of pulses produced in response to the ignition impulses by a predetermined number. For instance, if the engine is of a 4-cycle and 4-cylinder type, the number of pulses produced in response to the ignition impulses is divided by two so that the number of pulses becomes one half of the ignition impulses. The pulse width of the pulses produced by the pulse generator 12 is predetermined and is constant. The pulse signal produced by the pulse generator 12 is designated by a reference $S_2$.

The outputs of the airflow meter 10 and the pulse generator 12 are respectively connected to first and second inputs of the first pulse width modulation circuit 14. The first pulse width modulation circuit 14 produces an output pulse signal $S_3$ by modifying the pulse width of the pulse signal $S_2$ in accordance with the magnitude of the signal $S_1$ which is indicative of the airflow rate. The output of the first pulse width modulation circuit 14 is connected to a first input 16-1 of the second pulse width modulation circuit 16. The second pulse width modulation circuit 16 produces an output pulse signal $S_4$ by modifying the pulse width of the pulse signal $S_3$ in accordance with the magnitude of a correction signal $S_8$ applied to the second input 16-2 thereof. The correction signal $S_8$ is produced in the function generator 22 in accordance with various engine parameters such as engine temperature indicated by a coolant temperature signal $S_5$, an intake air temperature signal $S_6$ and throttle valve opening degree signal $S_7$, and a fuel cut off control signal $S_9$ produced in the fuel cut off control signal generator 80.

The output pulse signal $S_4$ produced by the second pulse width modulator 16 is then fed to the driving circuit 18 which produces a plurality of injection valve energizing signals. The number of the energizing signals corresponds to the number of the injection valves 20 which usually corresponds to the number of cylinders of the engine. The injection valve energizing signals are produced in turn so that each of the fuel injection valves 20 is energized to permit the transmission of fuel accordingly.

Since each of the fuel injection valves 20 is energized for a period of time corresponding to the pulse width of the pulse signal $S_4$, the fuel flow rate is controlled in accordance with the pulse width of the pulse signal $S_4$, If desired, a closed loop air/fuel ratio control circuit (not shown) may be combined with the fuel injection system for performing a feedback control in accordance with the concentration of a component contained in the exhaust gases.

The fuel cut off control signal generator 80 includes a frequency-voltage (F-V) converter 32, first and second comparators 34 and 38, a flip-flop 42, an OR gate 44, a NAND gate 48, first, second and third NOT gates 46, 58 and 62, first and second monostable multivibrators 56 and 64, a diode 66, resistors 50, 60, 68 and 70, a capacitor 52, and first (n-p-n type) and second (p-n-p type) transistors 54 and 72.

An input of the frequency-voltage converter 32 is connected to the output of the pulse generator 12 for receiving the pulse signal $S_2$. The output of the frequency-voltage converter 32 is connected to a noninverting input of the first comparator 34 and to an inverting input of the second comparator 38. Terminals 36 and 40 which are respectively connected to inverting and noninverting inputs of the first and second comparators 34 and 38 are fed with first and second predetermined reference voltages $V_1$ and $V_2$. These reference voltages may be produced by suitable voltage dividers (not shown). The first reference voltage $V_1$ is higher than the second reference voltage $V_2$. With this arrangement the first comparator 34 produces an output signal when voltage applied to the noninverting input thereof from the frequency-voltage converter 32 is higher than the first reference voltage $V_1$ while the second comparator 38 produces an output voltage when the voltage applied to the inverting input thereof from the frequency-voltage converter 32 is lower than the second reference voltage $V_2$. This means that the first comparator 34 produces the output signal when the rotational speed (rpm) of the engine is above a first predetermined value $n_1$, while the second comparator 38 produces the output signal when the rotational speed of the engine is below a second predetermined value $n_2$ which is lower than the first predetermined value $n_1$.

The output of the first comparator 34 is connected to a set terminal J of the flip-flop 42 which is of a J-K type, while the output of the second comparator 38 is connected to a second input of the OR gate 44 the output of which is connected to a reset terminal K of the flip-flop 42. An input of the first NOT gate 46 and a second input of the NAND gate 48 are connected to each other and are further connected to the throttle valve switch 30. The throttle valve switch 30 is operatively connected to the throttle valve of the engine so as to produce a logic "1" signal when the throttle valve is fully closed since one terminal of the switch 30 is fed with a predetermined voltage +V via a terminal 28. The output of the first NOT gate 46 is connected to a second input of the OR gate 44. The output Q of the flip-flop 42 is connected to a first input of the NAND gate 48. The output of the NAND gate 48 is directly connected to an input of the first monostable multivibrator 56 and is connected via the third NOT gate 62 to an input of the second monostable multivibrator 64. The output of the NAND gate 48 is further connected via the resistor 50 to the collector of the first transistor 54. The output of the first monostable multivibrator 56 is connected to an input of the second NOT gate 58 the output of which is connected via a resistor 60 to a base of the first transistor 54. The output of the second monostable multivibrator 64 is connected to one terminal of a resistor 68 the other terminal of which is connected to a base of the second transistor 72. The base of the second transistor 72 is connected via a resistor 70 to ground while the emitter of the same is directly connected to ground. The collector of the second transistor 72 is connected to the emitter of the first transistor 54 while capacitor 52 is interposed between the emitter of the first transistor 54 and ground. A junction to which the resistor 50, the capacitor 52 and the emitter of the first transistor 54 are connected is denoted by a reference numeral 74. The collector of the first transistor 54 is connected to an input of the function generator 22 for supplying a fuel cut off control signal $S_9$. The output of the NAND gate 48 is further connected to an anode of a diode 66 the cathode of which is connected to the output of the second monostable multivibrator 64.

Although the construction of the fuel cut off control signal generator 80 is described hereinabove it is to be noted that the conventional fuel cut off control signal generator does not include elements following the NAND gate 48. In other words, in a conventional fuel cut off control signal generator the output of the NAND gate 48 is directly connected to the function generator 22. Since the output signal of the NAND gate 48 is of logic levels, i.e. logic "0" or logic "1", the voltage of the fuel cut off control signal varies abruptly so that the pulse width of the pulse signal $S_4$ changes suddenly in the same manner. According to the present invention, since the resistor 50 and the capacitor 52 constitute an integrator (smoothing circuit) and functions as a charge-discharge circuit, the voltage of the fuel cut off control signal $S_9$ varies gradually for a predetermined period of time. A detailed description of the function of the fuel cut off control signal generator 80 will be made hereinafter.

As mentioned hereinbefore, the first comparator 34 produces an output signal indicating that the rotational speed of the engine is over the first predetermined value $n_1$. Upon presence of the output signal of the first comparator 34 the flip-flop 42 is set so that a logic "1" signal is produced at the output Q of the flip-flop 42. The logic "1" signal is applied to the first input of the NAND gate 48. At the same time if the throttle valve is fully closed, the throttle valve switch 30 produces an output logic "1" signal which is fed to the second input of the NAND gate 48. When both of the inputs of the NAND gate 48 are respectively fed with logic "1" signals, the NAND gate 48 produces a logic "0" signal. The NAND gate 48 maintains the logic "0" output signal until at least one of the inputs thereof is supplied with a logic "0" signal.

When the rotational speed of the engine decreases and drops below the second predetermined value $n_2$, the second comparator 38 produces an output signal, which is fed via the OR gate 44 to the reset terminal K of the flip-flop 42. Therefore, the flip-flop 42 is reset and the output of the same assumes a logic "0" level. However, if the throttle valve is opened, a logic "0" signal is fed to the second input of the NAND gate 48 so that the output of the NAND gate 48 becomes logic "1". Meanwhile the logic "0" signal derived from the throttle valve switch 30 is inverted into a logic "1" signal by the first NOT gate 46 and the logic "1" signal is applied via the OR gate 44 to the reset terminal K of the flip-flop 42 so that the flip-flop 42 output becomes logic "0".

Although the fuel cut off control signal generator 80, in fact, includes various elements, such as the first and second monostable multivibrators 56 and 64, following the NAND gate 48, at this time let us suppose that the circuitry following the NAND gate 48 includes only the resistor 50 and the capacitor 52 so that the junction 74 is directly connected to the function generator 22.

While the output of the NAND gate 48 assumes a logic "1" level, the capacitor 52 is charged via the resistor 50. After the capacitor 52 is charged, the voltage at the junction 74 assumes a predetermined value. When the predetermined voltage is applied to the function generator 22 as the fuel cut off control signal, the function generator 22 produces an output signal $S_8$ which is determined in accordance with the coolant temperature signal $S_5$, intake air temperature signal $S_6$ and the signal $S_7$ indicative of the throttle valve being fully closed.

Further when the NAND gate 48 output signal becomes logic "0", the charge stored in the capacitor 52 starts discharging via the resistor 50 so that the voltage at the junction 74 decreases exponentially. It takes a predetermined period of time for the voltage at the junction 74 to be approximate zero. The predetermined period of time is determined by the time constant of the charge-discharge circuit (smoothing circuit).

Upon presence of the logic "1" signal at the output of the NAND gate 48 while the voltage at the junction 74 is zero, the capacitor 52 starts to be charged via the resistor 50 so that the voltage at the junction 74 increases exponentially in the opposite manner.

Figure 2:
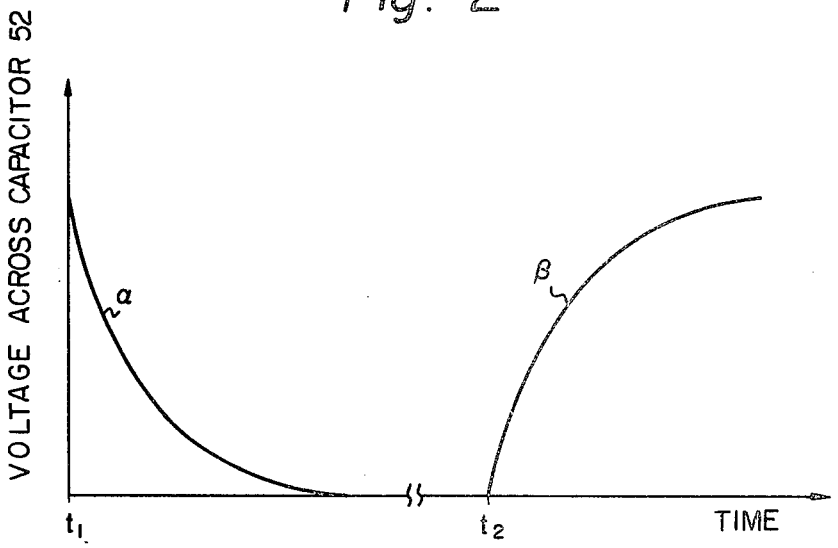
FIG. 2 shows a graph of the variations with respect to time of the voltage across the capacitor shown in FIG. 1.

FIG. 2 illustrates the variation of the voltage at the junction 74 shown in FIG. 1. A curve $\alpha$ shows the variation of the voltage when the voltage decreases, while a curve $\beta$ shows the variation of the voltage when the voltage increases. It is to be noted that the maximum voltage across the capacitor 52 corresponds to the voltage of the logic "1" signal.

The time constant of the charge-discharge circuit, i.e. the resistor 50 and the capacitor 52, may be suitably selected by means of changing the resistance of the resistor 50 and the capacitance of the capacitor 52 so that the slope of the curves such as the curves $\alpha$ and $\beta$ may be changed so as to be most suitable for the inherent characteristics of the engine and fuel injection system.

Figure 3:
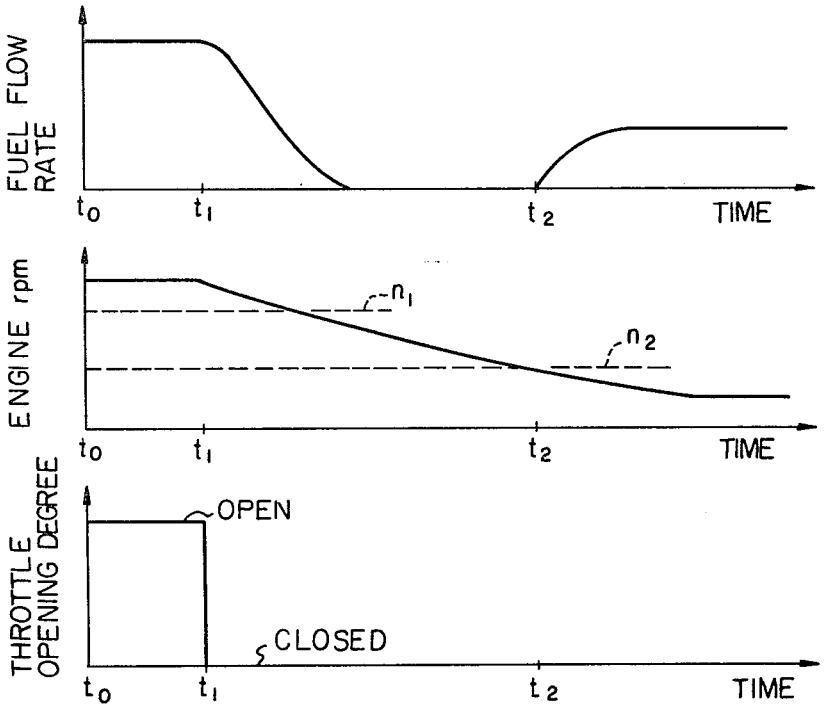
FIG. 3 shows graphs of the relationship with respect to time between the fuel flow rate, engine rpm and the opening degree of the throttle valve, which can be obtained when elements such as monostable multivibrators shown in FIG. 1 are not utilized.

FIG. 3 illustrates the relationship with respect to time between the fuel flow rate, the rotational speed of the engine and the opening degree of the throttle valve in the case that the voltage at the junction 74 varies as shown in FIG. 2. Between time $t_0$ and $t_1$, the rotational speed of the engine is over the first predetermined value $n_1$ and the opening degree of the throttle valve is over a predetermined value so that the fuel flow rate is controlled in accordance with the opening degree of the throttle valve which is operated by the accelerator pedal while the fuel flow rate is further controlled in accordance with various engine parameters applied to the function generator 22. In FIG. 3 the fuel flow rate during a period of time between time $t_0$ and time $t_1$ is shown to be constant for convenience. At time $t_1$, the throttle valve is suddenly closed to that the voltage at the junction 74 starts decreasing as shown by the curve $\alpha$ in FIG. 2. In accordance with the exponential decrease of the voltage of the fuel cut off control signal the voltage of the output signal $S_8$ of the function generator 22 decreases in the same manner so that the pulse width of the pulse signal $S_4$ becomes narrower and narrower till the pulse width becomes zero. With this arrangement the fuel flow rate decreases and finally the fuel supply to the cylinders of the engine is cut off. A first curve which indicates the fuel flow rate in FIG. 3 shows that the fuel flow rate exponentially decreases from time $t_1$.

Provided that there is no engine braking as the fuel flow rate decreases, the rotational speed of the engine decreases accordingly so that the rotational speed falls below the second predetermined value $n_2$ at time $t_2$. After time $t_2$ the voltage at the junction 74 starts increasing as shown by the curve $\beta$ shown in FIG. 2 so that the fuel flow rate gradually increases in the opposite manner. Since the airflow rate of the intake air sucked into the engine cylinders after time $t_2$ is lower than that of the intake air before time $t_1$, the fuel flow rate increases but reaches a level lower than that before time $t_1$ as shown in FIG. 3.

When the fuel flow rate decreases and then increases as shown in FIG. 3, however, a misfire is apt to occur when the fuel flow rate is below a given level. If such a misfire occurs, the amount of unburnt gases emitted from the engine increases, and thus the catalytic converter disposed in the exhaust passage of the engine is apt to overheat.

For eliminating such a disadvantage of the system, it is preferable to cut off the fuel supply when fuel flow rate is below a predetermined value. Several methods may be provided for achieving the abovementioned function of fuel cut off. For instance, it is possible not to cut off the fuel supply when the air/fuel ratio of the air/fuel mixture supplied to the engine is below a predetermined value or when the concentration of hydrocarbons contained in the exhaust gases is over a predetermined value.

Figure 4:
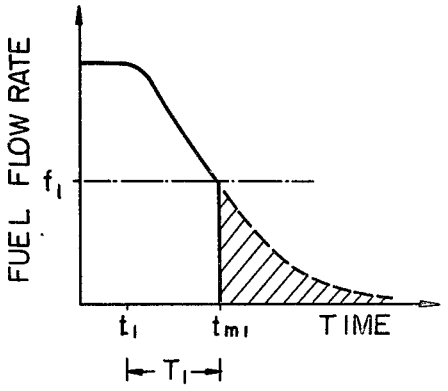
FIG. 4 shows a graph of the fuel flow rate variation with respect to time in case of fuel cut off, which can be obtained when all elements shown in FIG. 1 are utilized.
Figure 5:
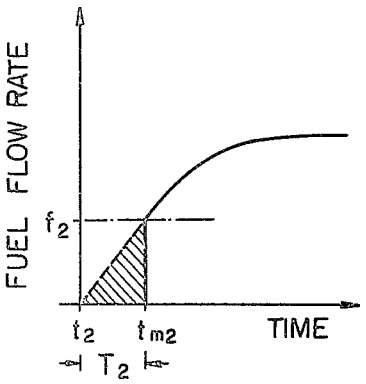
FIG. 5 shows a graph of the fuel flow rate variation with respect to time in case of reestablishment of the fuel supply, which can be obtained when all elements shown in FIG. 1 are utilized.

FIG. 4 and FIG. 5 respectively illustrate fuel flow rate characteristics of the fuel injection system according to the present invention. FIG. 4 shows the fuel flow rate variation when the fuel flow rate decreases while FIG. 5 shows the fuel flow rate variation when the fuel flow rate increases. In FIG. 4, when the fuel flow rate drops below a predetermined value $f_1$, the engine misfires, from time $t_{m1}$, while in FIG. 5 until the fuel flow rate exceeds a predetermined value $f_2$ the engine misfires until time $t_{m2}$. Hatched portions in FIG. 4 and FIG. 5 respectively indicate misfire portions. It is found that a period of time $T_1$, defined between time $t_1$ and $time_{m1}$ is substantially constant throughout various engine operations. In the same manner it is found that a period of time $T_2$ defined between time $t_2$ and time $t_{m2}$ is substantially constant. In other words the period of time $T_1$ for which engine misfires when the fuel flow rate decreases to zero and the period of time $T_2$ for which the engine misfires when the fuel flow rate increase from zero are respectively about the same. Therefore, it is possible to determine a time $t_{m1}$ at which the fuel supply is cut off by selecting the time at the end of a predetermined period of time $T_1$ when the fuel flow rate decreases. In the same manner a time $t_{m2}$ at which the fuel supply is reestablished is determined.

FIG. 4 indicates that the fuel flow rate decreases from time $t_1$ to time $t_{m1}$ exponentially and suddenly becomes zero at time $t_{m1}$. In the opposite manner FIG. 5 indicates that the fuel flow rate abruptly increases from zero to $f_2$ at time $t_{m2}$ and exponentially increases after time $t_{m2}$.

The method by which the above-mentioned fuel flow rate variation characteristics are achieved is described hereinafter. Turning back to FIG. 1 wherein the function of the fuel cut off control signal generator 80 was described under the assumption that the stage following the NAND gate 48 includes only the resistor 50 and capacitor 52 it will be readily understood that the remaining elements such as the first and second monostable multivibrators 56 and 54 are employed for achieving the above-mentioned fuel flow rate variation characteristics shown in FIG. 4 and FIG. 5. The actual function of the stage following the NAND gate 48 is described hereinafter. When the output of the NAND gate 48 assumes a logic "1" level, the capacitor 52 is charged so that the voltage at the junction 74 is maintained at a predetermined value as described hereinbefore.

When the output of the NAND gate 48 becomes logic "0", the NOT gate 62 inverts the logic "0" signal into a logic "1" signal and thus the input of the second monostable multivibrator 64 is fed with a logic "1" signal with which the second monostable multivibrator 64 is triggered. The second monostable multivibrator 64 thus produces an output phase signal the pulse width of which is determined by the time constant of the second monostable multivibrator 64 which corresponds to the period of time $T_1$ shown in FIG. 4. Since the output pulse of the second monostable multivibrator 64 is applied via a voltage divider consisting of the resistors 68 and 70 connected in series, to the base of the second transistor 72, the second transistor 72 becomes nonconductive (OFF). Consequently, the charge stored in the capacitor 52 starts discharging via the resistor 50 and thus the voltage at the junction 74 decreases exponentially. At time $t_{m1}$ the second transistor 72 becomes conductive (ON) since the output of the second monostable multivibrator 64 becomes logic "0". Therefore, the remaining charge stored in the capacitor 52 is discharged via the collector-emitter path of the second transistor 72 instantaneously so that the voltage at the junction 74 falls zero at times $t_{m2}$. Since the first transistor 54 is conductive (ON) at this time, the voltage variation at the junction 74 is directly transmitted via the collector-emitter path of the first transistor 54 to the function generator 22.

In case that the output of the NAND gate 48 becomes logic "1", the capacitor 52 starts to be charged via the resistor 50 at time $t_2$. Upon presence of the logic "1" signal the first monostable multivibrator 56 is triggered and thus produces an output logic "1". The output logic "1" signal is inverted by the second NOT gate 58 so that a logic "O" signal is supplied via the resistor 60 to the base of the first transistor 54. Therefore, the first transistor 54 becomes nonconductive (OFF) and thus the voltage variation at the junction 74 is not transmitted to the function generator 22. At time $t_{m2}$ the first transistor 54 becomes conductive (ON) since the pulse width of the output pulse of the first monostable multivibrator 56 corresponds to the period of time $T_2$ shown in FIG. 5. As soon as the first transistor 54 becomes conductive the voltage at the junction 74 is transmitted to the function generator 22 so that the exponentially increasing voltage is fed to the function generator 22 and thus the pulse width of the pulse signal $S_4$ increases accordingly. It is to be noted that while the output of the NAND gate 48 is of a logic "1" level, the logic "1" signal is fed to the voltage divider including the resistors 68 and 70 via the diode 66 so that the second transistor 72 is maintained nonconductive (OFF). As described in the above, the first and second transistors 54 and 72 are utilized as switching elements. Therefore, it will be understood that the functions of the switching elements are to permit the transmission of the voltage at the junction 74 for a first predetermined period of time $T_1$ and to prohibit the transmission of the same for a second predetermined period of time $T_2$ respectively. If desired, other switching elements such as relays may be used instead of transistors.

From the foregoing it will be understood that the fuel flow rate varies as shown in FIG. 4 and FIG. 5 in accordance with the variation of the engine rotational speed and the opening degree of the throttle valve. Although FIG. 4 and FIG. 5 indicate respectively the variation of the fuel flow rate, the variation of the voltage of the cut off control signal $S_9$ may be represented by the curves shown in FIG. 4 and FIG. 5 in the same manner since the voltage variation directly causes the fuel flow rate variation, while the engine parameters other than the rotational speed of the engine and the opening degree of the throttle valve, do not change.

According to the preferred embodiment shown in FIG. 1, the ON-OFF type output voltage of the NAND gate 48 is applied to the charge-discharge (smoothing) circuit consisting of the resistor 50 and the capacitor 22 so that the voltage at the junction 74 varies exponentially. However, other circuit arrangement following the NAND gate 48 may be adopted. For instance, the ON-OFF type output voltage of the NAND gate 48 may be applied to a digital circuit in which a stepwise fuel cut off control signal is produced. For achieving such a stepwise variation of the voltage, a suitable staircase wave generator may be used instead of the smoothing circuit.

Moreover, if the fuel cut off control signal generator includes circuitry such as a micro computer in which operations are carried out in accordance with a preset program, the voltage of the fuel cut off control signal $S_9$ may be changed in various manners for instance in accordance with the predetermined total rotations of the engine rather than a predetermined period of time.

Figure 6:
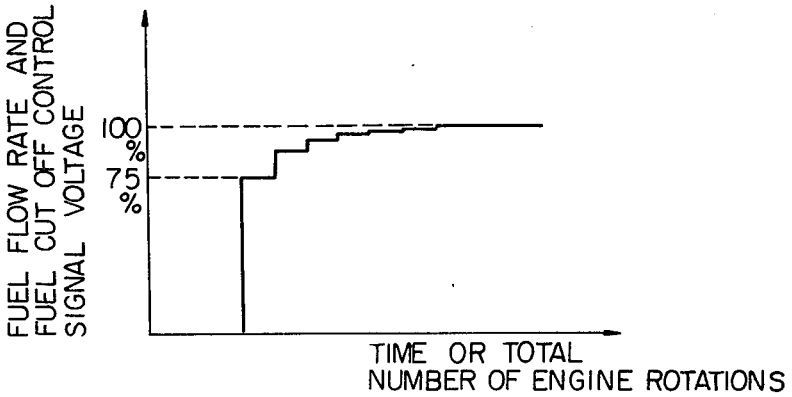
FIG. 6 shows in a graph the variation of a fuel cut off control signal provided by a micro computer.

FIG. 6 illustrates the variation of the fuel flow rate which is controlled by a fuel cut off control signal the voltage variation of which is also indicated by the same graph. The voltage of the fuel cut off control signal as well as the fuel flow rate varies (increase in this case) as time goes or as the total number of rotations of the engine increases. The voltage is arranged to increase to a given extent such as 75% of the maximum at one time and then increases stepwisely for instance one half by one half of the remaining voltage.

Figure 7:
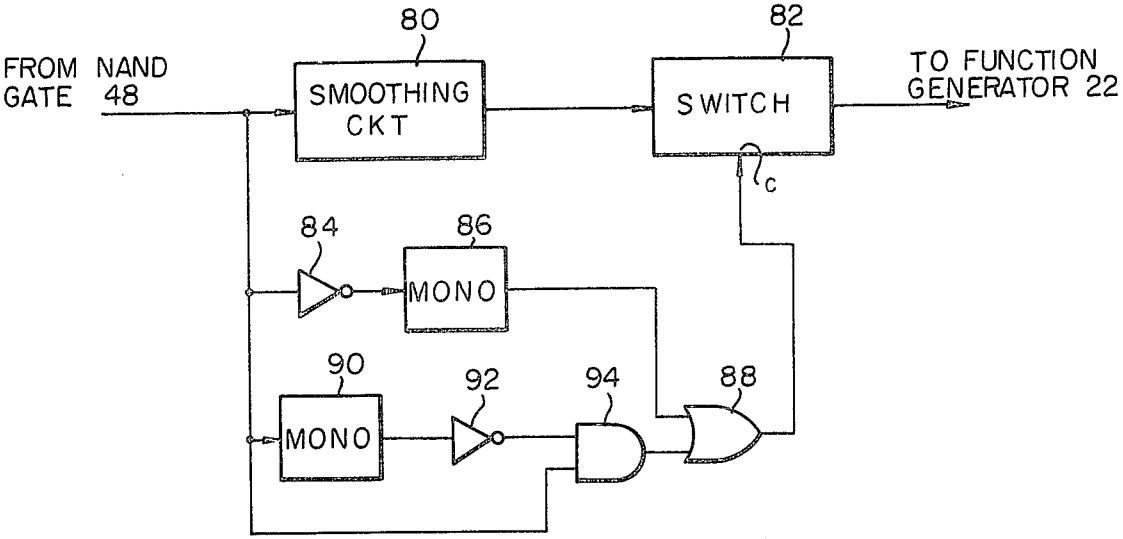
FIG. 7 shows in block diagram form a variation of the stage following the NAND gate shown in FIG. 1.

Reference is now made to FIG. 7 which shows a variation of the circuitry following the NAND gate 48 shown in FIG. 1. The circuitry shown in FIG. 7 includes a smoothing circuit 80, a switching circuit 82, first and second NOT gates 84 and 82, first and second monostable multivibrators 86 and 90, an AND gate 94, and an OR gate 88.

The smoothing circuit 80 may consist of a resistor and a capacitor as shown in FIG. 1. If desired, an integrator consisting of an operational amplifier may be used for the smoothing circuit 80. The switching circuit 82 may be a transistor or a relay. The switching circuit 82 is arranged to close (turn ON) when a signal is applied to a control terminal "c" thereof. The output of the NAND gate 48 shown in FIG. 1 is connected to an input of the smoothing circuit 80, an input of the first NOT gate 84, an input of the second monostable multivibrator 90, and to an input of the AND gate 94. The output of the first NOT gate 84 is connected to an input of the first monostable multivibrator 86 the output of which is connected to an input of the OR gate 88. The output of the second monostable multivibrator 90 is connected to an input of the second NOT gate 92 the output of which is connected to the other input of the NAND gate 94. The output of the AND gate 94 is connected to the other input of the OR gate the output of which is connected to the control terminal "c" of the switching circuit 82. The output of the switching circuit 82 is connected to the function generator 22 shown in FIG. 1.

The function of the circuitry shown in FIG. 7 will be described hereinafter. The smoothing circuit 80 smoothes the output voltage of the NAND gate 48 whenever the voltage changes. The output of the smoothing circuit 80 is applied to the switching circuit 82 input so that the smoothed voltage is applied to the function generator 22 via the switching circuit 82 when the switching circuit 82 is closed.

Assuming the output signal of the NAND gate 48 is logic "1", the logic "1" signal is directly applied to one input of the AND gate 94, while the second monostable multivibrator 90 is triggered to produce an output logic "1" pulse signal. The logic "1" pulse signal is inverted by the second NOT gate 92 and thus the other input of the AND gate 94 is fed with a logic "0" signal for a predetermined period of time defined by the pulse width of the logic "1" pulse signal of the second monostable multivibrator 90. With this arrangement, the AND gate 94 produces a logic "1" output signal after a predetermined period of time when the NAND gate 48 produces a logic "1" signal. The logic "1" output of the AND gate 94 is then fed via the OR gate 88 to the control terminal "c" of the switching circuit 82 so that the output of the smoothing circuit 80 is transmitted to the function generator 22.

When the output of the NAND gate 48 changes to logic "0" from logic "1", the first NOT gate 84 produces a logic "1" signal with which the first monostable multivibrator 86 is triggered. The first monostable multivibrator 86 then produces a logic "1" pulse signal for a predetermined period of time which is applied via the OR gate 88 to the control terminal "c" of the switching circuit 82. Consequently, the switching circuit 82 opens (turns OFF) for a predetermined period of time defined by the pulse width of the first monostable multivibrator 86 output pulse signal and therefore the output of the smoothing circuit 80 is not transmitted to the function generator 22 for the same period of time after the NAND gate 48 output signal becomes logic "0" from logic "1".

It will be understood that the circuitry shown in FIG. 7 functions in the same manner as the circuitry following the NAND gate 48 shown in FIG. 1. Therefore, The fuel flow rate varies as shown in FIG. 4 and FIG. 5 (as indicated by the solid lines) in the same manner. In the circuitry shown in FIG. 1 two transistors are used for switching the output of the smoothing circuit consisting of the resistor 50 and the capacitor 52. However, in the circuitry shown in FIG. 7, only one switching element such as a transistor or a relay is required for the switching circuit 82. It is to be noted that the switching circuit 82 is interposed between the smoothing circuit 80 and the function generator 22 so as to complete a series circuit, while the first transistor 54 shown in FIG. 1 is interposed between the smoothing circuit consisting of the resistor 50 and the capacitor 52 and the function generator 22 in the same manner and the second transistor 72 is interposed between the smoothing circuit and ground so as to shunt the output voltage of the smoothing circuit to ground. Therefore, it will be understood that in both cases shown in FIG. 1 and FIG. 7, the first and second transistors 54 and 72 which are utilized as switching elements and the switching circuit 82 are employed to control the transmission of the smoothing circuit output signal.

It will be understood from the foregoing description that the fuel injection system according to the present invention provides a smooth fuel cut off and smooth reestablishment of the fuel supply so that the variation in engine torque is smooth at transient points. Although the efficiency of the engine brake, fuel consumption and the efficiency of the reduction of the harmful components is reduced a little bit compared to a conventional fuel cut off method, these factors are maintained within practical levels. Further, if the rotational speed of the engine at the transient points, i.e. the time when the fuel supply is cut off and the time when the fuel supply is reestablished, is set a little lower than a conventional fuel injection system, the above-mentioned deterioration of the factors may be compensated for.

Obviously many modifications and variations of the present invention are possible in the light of the above teachings. It is therefore to be understood that within the scope of the appended claims the invention may be practised otherwise than as specifically described.

What is claimed is:

1. A fuel injection system equipped with a fuel cut off control signal generator, for an automotive internal combustion engine including; means for measuring an airflow rate of the intake air; means for producing a first pulse signal in response to the ignition pulses of said engine; means for modifying the pulse width of said first pulse signal in accordance with the measured airflow rate and for producing a second pulse signal; means for modifying the pulse width of said second pulse signal in accordance with the engine parameters and for producing a third pulse signal; means for driving fuel injection valves of said engine in accordance with said third pulse signal; and means for producing a fuel cut off control signal in accordance with the rotational speed of said engine and the opening degree of the throttle valve of said engine, the fuel cut off control signal being utilized for modifying the pulse width of said second pulse signal in accordance with the voltage thereof; wherein the improvement comprises:

(a) means for gradually varying the voltage of said fuel cut off control signal with respect to time when the voltage of said fuel cut off control signal changes abruptly, said means for gradually varying comprises a smoothing circuit having a time constant;

(b) first timer means for producing a first signal for a first predetermined period of time from the time the voltage of the input signal of said smoothing circuit decreases;

(c) second timer means for producing a second signal for a second predetermined period of time from the time the voltage of the input signal of said smoothing circuit increases;

(d) means for producing a third signal after said second predetermined period of time until the voltage of the input signal of said smoothing circuit starts decreasing; and (e) switching means responsive to said first, second and third signals for transmitting and blocking the output signal of said smoothing circuit.

2. A fuel injection system as claimed in claim 1, wherein said smoothing circuit comprises: an integrator.

3. A fuel injection system as claimed in claim 1, wherein each of said first and second timer means comprises a monostable multivibrator.

4. A fuel injection system as claimed in claim 1, wherein said switching means comprises: a first transistor interposed in the output line of said smoothing circuit, and a second transistor interposed between the output of said smoothing circuit and ground.

5. A fuel injection system equipped with a fuel cut off control signal generator, for an automotive internal combustion engine, comprising:

(a) an airflow meter for producing a first signal indicative of the intake airflow rate;

(b) an airflow meter for producing a first signal indicative of the intake airflow rate;

(b) a pulse generator including a divider for producing a second signal in the form of pulses in response to ignition pulses of said engine;

(c) a first pulse width modulation circuit responsive to said first and second signals, the pulse width of said second signal being modified in accordance with the first signal so as to produce a third signal in the form of pulses;

(d) a function generator responsive to engine parameters and to a fuel cut off control signal applied thereto for producing a correction signal;

(e) a second pulse width modulation circuit responsive to said third signal and to said correction signal, the pulse width of said third signal being modified in accordance with the correction signal so as to produce a fourth signal in the form of pulses;

(f) a driving circuit responsive to said fourth signal for producing a plurality of fuel injection valve energizing signals;

(g) fuel injectors each of which is responsive to one of said fuel injection valve energizing signals;

(h) a frequency-voltage converter responsive to said second signal for producing a signal indicative of the rotational speed of said engine;

(i) a first comparator responsive to said frequency-voltage converter output signal for producing a signal indicative that the rotational speed is above a first predetermined value;

(j) a second comparator responsive to said frequency-voltage converter output signal for producing a signal indicating that the rotational speed is below a second predetermined value which is below said first predetermined value;

(k) a throttle valve switch operatively connected to the throttle valve of said engine for producing a signal indicating that the throttle valve is fully closed;

(l) a binary circuit the set terminal of which is responsive to the first comparator output signal, the reset terminal of said binary circuit being responsive to the second comparator output signal and to the throttle valve switch output signal;

(m) a logic gate responsive to the binary circuit output signal and to the throttle valve switch output signal for producing an ON-OFF signal;

(n) a smoothing circuit interposed between said logic gate and said function generator for smoothing said ON-OFF signal, the output of said smoothing circuit being fed to said function generator as said fuel cut off control signal;

(o) a first monostable multivibrator responsive to the decrease in voltage of the output signal of said logic gate for producing an output pulse signal;

(p) a first switching element responsive to the output signal of said first monostable multivibrator, said first switching element being interposed between said smoothing circuit and said function generator for blocking the output signal of said smoothing circuit for a predetermined period of time defined by the output pulse signal of said first monostable multivibrator;

(q) a second monostable multivibrator responsive to the increase in voltage of the output signal of said logic gate for producing an output pulse signal; and (r) a second switching element responsive to the output signal of said second monostable multivibrator and to the output of said logic gate for shunting the output of said smoothing circuit after a predetermined period of time defined by the output signal of said second monostable multivibrator until the output voltage of said logic gate increases.

6. A fuel injection system equipped with a fuel cut off control signal generator, for an automotive internal combustion engine, comprising:

(a) an airflow meter for producing a first signal indicative of the intake airflow rate;

(b) a pulse generator including a divider for producing a second signal in the form of pulses in response to ignition pulses of said engine;

(c) a first pulse width modulation circuit responsive to said first and second signal, the pulse width of said second signal being modified in accordance with the first signal so as to produce a third signal in the form of pulses;

(d) a function generator responsive to engine parameters and to a fuel cut off control signal applied thereto for producing a correction signal;

(e) a second pulse width modulation circuit responsive to said third signal and to said correction signal, the pulse width of said third signal being modified in accordance with the correction signal so as to produce a fourth signal in the form of pulses;

(f) a driving circuit responsive to said fourth signal for producing a plurality of fuel injection valve energizing signals;

(g) fuel injectors each of which is responsive to one of said fuel injection valve energizing signals;

(h) a frequency-voltage converter responsive to said second signal for producing a signal indicative of the rotational speed of said engine;

(i) a first comparator responsive to said frequency-voltage output signal for producing a signal indicating that the rotational speed is above a first predetermined value;

(j) a second comparator responsive to said frequency-voltage converter output signal for producing a signal indicating that the rotational speed is below a second predetermined value which is below said first predetermined value;

(k) a throttle valve switch operatively connected to the throttle valve of said engine for producing a signal indicating that the throttle valve is fully closed;

(l) a binary circuit the set terminal of which is responsive to the first comparator output signal, the reset terminal of said binary circuit being responsive to the second comparator output signal and to the throttle valve switch output signal;

(m) a logic gate responsive to the binary circuit output signal and to the throttle valve switch output signal for producing an ON-OFF signal;

(n) a smoothing circuit interposed between said logic gate and said function generator for smoothing said ON-OFF signal, the output of said smoothing circuit being fed to said function generator as said fuel cut off control signal;

(o) a first monostable multivibrator responsive to the decrease of the voltage of the output signal of said logic gate for producing an output signal for a predetermined period of time;

(p) a second monostable multivibrator responsive to the increase of the voltage of the output signal of said logic gate for producing an output signal for a predetermined period of time;

(q) an AND gate responsive to said second monostable multivibrator output signal and to the output signal of said logic gate;

(r) an OR gate responsive to the output of said first monostable multivibrator and to the output of said AND gate for producing a switch control signal; and (s) switching means for permitting the transmission of the output signal of said smoothing circuit in accordance with said switch control signal.

* * * * *